US005671910A

United States Patent [19]

Davies et al.

[11] Patent Number: 5,671,910

[45] Date of Patent: Sep. 30, 1997

[54] VACUUM PLATES

[75] Inventors: David Davies, 12 Gibbs Close, Finchampstead, Berkshire, Great Britain, RG11 4TY; Laurence R. Petrie, 8 North Lake Road, Alfred Cove, Australia, 6154

[73] Assignees: James C. Carne; Charles N. Carne; David Davies, all of, United Kingdom; Laurence R. Petrie, Australia

[21] Appl. No.: 331,636

[22] PCT Filed: Apr. 29, 1993

[86] PCT No.: PCT/GB93/00902

§ 371 Date: Apr. 25, 1995

§ 102(e) Date: Apr. 25, 1995

[87] PCT Pub. No.: WO93/22104

PCT Pub. Date: Nov. 11, 1994

[30] Foreign Application Priority Data

May 6, 1992 [GB] United Kingdom ..... 9209716
Dec. 9, 1992 [IL] Israel ..... 104040

[51] Int. Cl.[6] ..... B25B 11/00

[52] U.S. Cl. ..... 269/21

[58] Field of Search ..... 248/362, 363; 269/21, 20; 451/388; 279/3 R; 294/64.1

[56] References Cited

U.S. PATENT DOCUMENTS

| | | | |
|---|---|---|---|
| 3,598,006 | 8/1971 | Gerber | 269/21 |
| 3,711,082 | 1/1973 | Seidenfaden | 269/21 |
| 4,221,356 | 9/1980 | Fortune | 269/21 |
| 4,778,326 | 10/1988 | Althouse et al. | 269/21 |
| 4,799,722 | 1/1989 | Marzinotto | 269/21 |
| 4,856,766 | 8/1989 | Huberts | 269/21 |
| 5,028,182 | 7/1991 | Park | 269/21 |
| 5,427,363 | 6/1995 | Rink et al. | 369/21 |

FOREIGN PATENT DOCUMENTS

| | | | |
|---|---|---|---|
| 148023 | 5/1981 | Germany | 269/21 |
| 126382 | 1/1976 | Japan . | |
| 3-270048 | 12/1991 | Japan | 269/21 |
| 5-16084 | 3/1993 | Japan . | |
| 650776 | 3/1979 | U.S.S.R. | 269/21 |

*Primary Examiner*—Robert C. Watson
*Attorney, Agent, or Firm*—Nixon & Vanderhye

[57] ABSTRACT

A vacuum plate system comprises a support plate (310) formed of a plurality of support plate modules (320–380) that are supported on a base plate, and serve to transfer vacuum between vacuum apertures in the base plate and a workpiece held on the support plate (310). The support plate module (340) is formed with a plurality of circular lip seals (341) of larger size, and disposed therebetween, a plurality of lip seals (349) of smaller size. The area within each of the lip seals (341, 349) has a small hole extending through the respective support plate module, to transfer vacuum in a restricted manner. The remaining support plate modules are of a similar configuration, but with variations. In machining of a workpiece held on the support plate modules (320–280), the modules may be cut into, without risk of losing the vacuum overall holding effect on the workpiece. The specification discloses various other support plates.

24 Claims, 9 Drawing Sheets

VACUUM PLATES

This invention relates to vacuum plates.

BACKGROUND OF THE INVENTION

Vacuum plates are well known in the engineering field as means for holding a workpiece securely in place whilst a machining operation is performed on it. They may take various shapes. For example, they may be generally flat, rectangular tables, which afford a substantially horizontal support surface workpieces. Alternatively, they may be of circular shape, affording a substantially upright support surface upon which a workpiece is secured, in the manner of a chuck.

In fact, such a latter configuration may be referred to as a "vacuum chuck", but for the sake of convenience, in this specification, the term "vacuum plate" is used to refer to all possible configurations of support means which retain a workpiece or other article in position by means of a vacuum—whether for machining, any other operation, or simply holding and/or transport. Although the term "vacuum" is used here conveniently, it is usually the case in practice that a perfect vacuum is never achieved—an average pressure of around 0.1 bar is more usual.

In the published specification of our PCT patent application No. WO 92/10336, we disclose a number of vacuum plate systems each of which comprises a base plate for providing a source of vacuum distributed over an area of the plate, and a support plate which is disposed between the base plate and a workpiece to be held by the vacuum plate system.

Various support plates are disclosed, and their purpose generally is to transfer a vacuum as effectively as possible from a base plate to a workpiece, in order to hold the workpiece as firmly as possible whilst, for example, a machining operation is performed upon it. A useful advantage of the support plates is that they may be cut into during a machining operation, and replaced and/or recycled.

A number of interesting features are disclosed also of the base plates, intermediate plates and/or pressure supply arrangements. All or any of the many features disclosed in our above-mentioned specification WO 92/10336 may be combined, where practicable, with the features of the present specification, and the reader's attention is specifically directed to our above-mentioned specification WO 92/10336, the contents of which are incorporated herein by reference.

BRIEF DESCRIPTION OF THE INVENTION

Preferred embodiments of the present invention aim to provide improved support plates and vacuum plate systems incorporating such support plates.

According to a first aspect of the present invention, there is provided a support plate adapted to be disposed between a base plate of a vacuum plate system and a workpiece to be held by the vacuum plate system, the support plate comprising:

- a sheet of material having a reverse surface and a working surface for contact respectively with a said base plate and workpiece;
- at least one hole that passes through the sheet of material to transfer vacuum, in use, between said reverse and working surfaces; and
- a plurality of resilient projections each provided on said working surface to form, in use, a seal with a contact surface of a respective workpiece:

wherein, in plan view, the seal formed by each of said resilient projections has a closed shape and seals of a smaller size are interposed between seals of a larger size.

Said closed shape may be a circular shape.

A plurality of said holes may be provided in said sheet of material.

Each of said holes may be located within a respective one of said closed shapes.

At least one of said closed shapes may not have a respective said hole within it.

Preferably, said projections are formed integrally in said sheet.

According to a second aspect of the present invention, there is provided a support plate adapted to be disposed between a base plate of a vacuum plate system and a workpiece to be held by the vacuum plate system, the support plate comprising:

- a sheet of material having a reverse surface and a working surface for contact respectively with a said base plate and workpiece;
- at least one hole that passes through the sheet of material to transfer vacuum, in use, between said reverse and working surfaces; and
- a network of open grooves formed in at least said working surface to open into that surface.

A respective said network of open grooves may be formed in each of said reverse and working surfaces to open into the respective surface.

Preferably, said hole opens into at least one said network of grooves.

At least one said network may comprise a rectangular array of grooves.

The invention extends to a support plate according to any of the first aspects of the invention and also according to any of the second aspects of the invention.

According to a third aspect of the present invention, there is provided a support plate adapted to be disposed between a base plate of a vacuum plate system and a workpiece to be held by the vacuum plate system, the support plate comprising:

- a sheet of material having a reverse surface and a working surface for contact respectively with a said base plate and workpiece;
- at least one hole that passes through the sheet of material to transfer vacuum, in use, between said reverse and working surfaces; and
- a resilient projection that is formed integrally with said sheet at or adjacent the periphery of the sheet to form, in use, a seal that extends around said periphery and engages a contact surface of either a respective said base plate or a respective said workpiece.

Said resilient projection may extend from said working surface or said reverse surface.

Preferably, a respective said resilient projection extends from each of said reverse and working surfaces to form, in use, a respective seal that extends around said periphery and engages respectively a contact surface of a respective said base plate or a respective said workpiece.

Preferably, said seal or at least one of said seals extends around a major portion of said periphery.

Preferably, said seal or at least one of said seals extends continuously around said periphery.

The invention extends to a support plate according to any of the third aspects of the invention and also according to any of the first and/or second aspects of the invention.

Preferably, said material is a flexible material.

Preferably, said material is a plastics material.

Preferably, at least one of said surfaces of the support plate is formed with surface roughness to assist the transfer of positive or negative pressure across that surface.

Said surface roughness may be formed by abrasion of said surface or by a moulding or pressing process during manufacture of said support plate.

A support plate as above may comprise locating means which are provided on said reverse surface and cooperate with means on a respective said base plate to locate the support plate in position on the base plate.

A support plate as above may be of a substantially circular or part-circular overall shape in plan view.

A support plate as above may comprise a plurality of lip seals that are formed on said working and/or reverse surface of the support plate and are circular or part-circular in plan view, being concentric with the circular or part-circular overall shape of the support plate.

A support plate as above may be provided with a hole at the centre of the circle of said circular or part-circular overall shape.

A plurality of support plates according to any of the preceding aspects of the invention may be of modular shape and size to make up a support plate area that is a multiple in size of a smallest module.

The invention extends to a vacuum plate system comprising a support plate according to any of the preceding aspects of the invention, and a respective said base plate having a vacuum connection port, at least one aperture opening into a support surface of the plate, and connection means connecting said aperture with said port.

A vacuum plate system as above may further comprise control means for controlling the supply of pressure to said at least one aperture.

According to another aspect of the present invention, there is provided a method of holding a workpiece, comprising the step of placing the workpiece on a vacuum plate system as above, and applying a reduced pressure to the connection port of said base plate to hold the workpiece on the support plate.

The invention extends to use of a support plate according to any of the preceding aspects of the invention in a method as above.

BRIEF DESCRIPTION OF THE DRAWINGS

For a better understanding of the invention, and to show how the same may be carried into effect, reference will now be made, by way of example, to the accompanying diagrammatic drawings, in which.

DETAILED DESCRIPTION OF PREFERRED EMBODIMENTS

Figure 1:
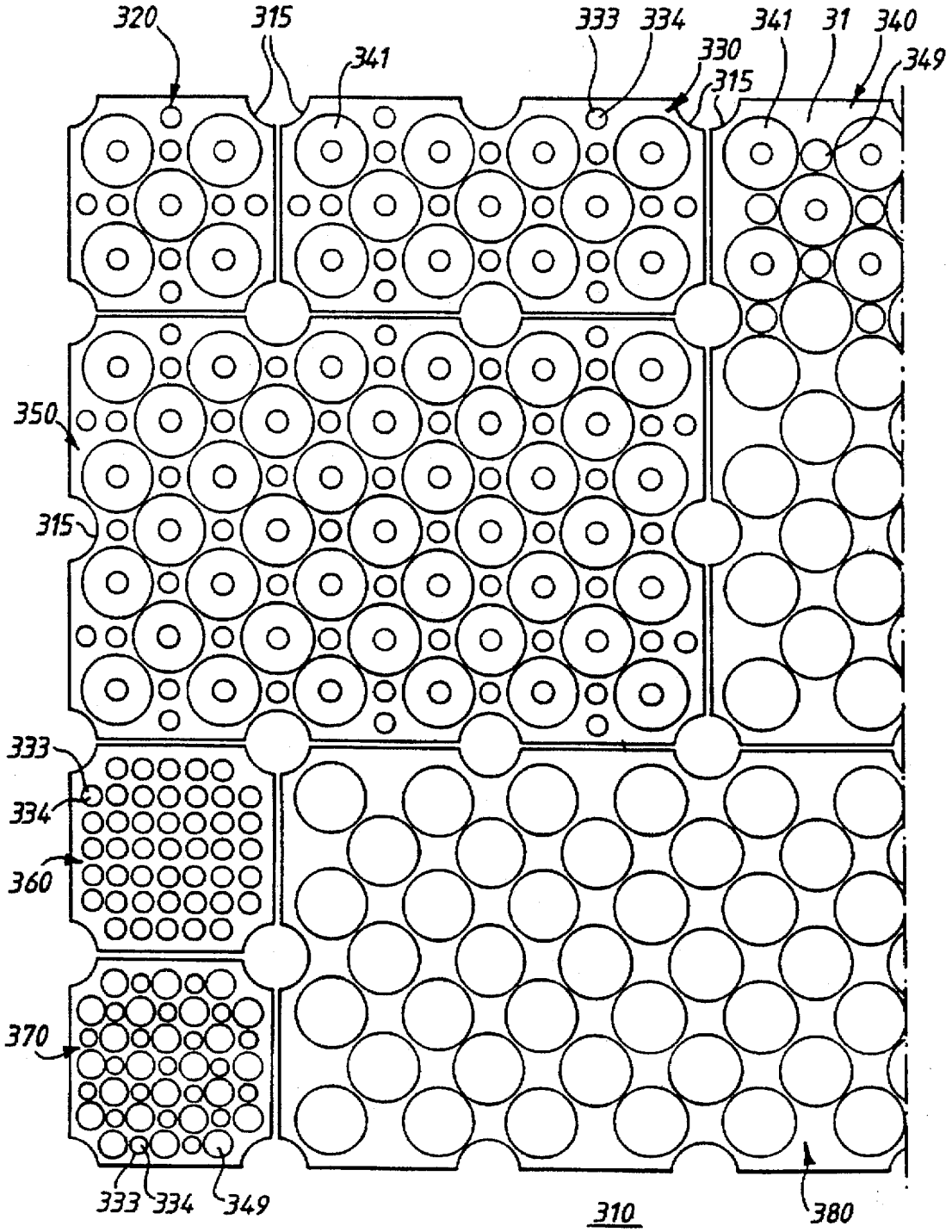
FIG. 1 shows, in plan view, a support plate made up of a plurality of different modules.

The support plate 310 that is shown in FIG. 1 is made up of a plurality of modules 320, 330, 340, 350, 360, 370 and 380. Each of the illustrated modules is rectangular in shape, having side dimensions that are integral multiples of (for example) 100 mm. Modules 320, 360 and 370 are of a minimum overall size, being 100 mm squares. Module 350 is an oblong of size 200 mm×300 mm, and so on.

Module 340 comprises a sheet of plastics material having an upper, working surface 31 and a lower, reverse surface 32. Disposed in the sheet of plastics material are a plurality of larger discs 341, between which there are interposed a plurality of smaller discs 349.

Figure 2:
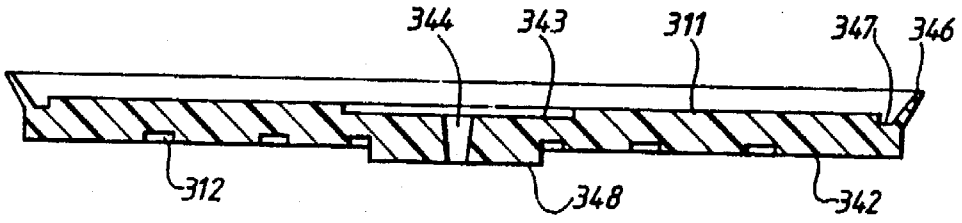
FIG. 2 is a sectional view through a component that may be used in one of the modules of the support plate of FIG. 1.

As may be seen in FIG. 2, each of the larger discs 341 has an upper, working surface 311 and a lower, reverse surface 342. An upstanding rib 346 extends from an external annular recess 347, pointing both upwardly and outwardly of the disc 341. The disc 341 is formed with a central recess 343, in the centre of which there is formed a small through hole 344. A spigot or boss 348 extends downwardly from the reverse surface 342.

In FIG. 2, the disc 341 is shown as a discrete item. It could be made as such, preferably of plastics, and incorporated into the module 340 by fixing it into a recess provided in the upper face of the module 340 therefor. To this end, adhesive may be provided in annular grooves 312 provided on the reverse surface 342 of the disc 341, to secure the disc 341 to the body of the module 340. However, in a preferred arrangement, discs such as 341 are actually formed integrally with the main body of the module 340—for example, for moulding, or by any other method (e.g. as disclosed in our above-mentioned specification WO 92/10336).

The smaller discs 349 have a configuration generally similar to that shown in FIG. 2—although the centre recess 343 of FIG. 2 may optionally be omitted.

The general operation of the support plate module 340 shown in FIG. 1 may readily be appreciated by reference to our above-mentioned PCT specification WO 92/10336. Briefly, vacuum applied to the underside of the module 340 is transferred across the reverse surface 32 thereof, and transmitted through the small through holes 344 to a workpiece engaged on the support plate module 340. The ribs 346 of the discs 341 serve as lip seals which may resiliently deform when a workpiece is placed thereon, and which maintain contact with a supported surface of the workpiece, even where there are local deformations of that supported surface. The small diameter of the through holes 344 limits the loss of vacuum through any uncovered holes (not in contact with the workpiece). The lip seals formed by the ribs 346 maintain a high degree of vacuum between support plate module 340 and workpiece, even if other discs 341, 349 are cut through in a machining operation.

An advantageous feature of the lip seals arrangement is that, once a seal has been made by way of a respective lip seal, the vacuum that prevails in the volume bounded by the lip seals serves to reinforce the sealing effect, due to the force exerted by the negative pressure drawing the lip seal and workpiece closely together.

An advantage of the discs 341 of FIGS. 1 and 2 is that the upstanding ribs 346, being circular in plan, deform in a more uniform manner than if the ribs were non-circular in plan. In the latter case—e.g. where the ribs are generally rectangular in plan—the ribs tend to have different deformation characteristics in the corner areas of the rectangles. It may be possible to compensate for this by varying the configuration of the ribs at the corner regions. However, this may be a less practical proposition, involving considerable cost and accuracy in manufacture. Forming the ribs 346 in circular form, as shown in FIG. 1, provides a much more simple and effective way of providing uniformity of deformation of the ribs 346 and associated lip seals.

By using discs such as 341, however, the evacuated areas bounded by lip seals tend to occupy less of the overall surface area of the support plate 340, than may be the case where the ribs are rectangular in plan view. To remedy this, therefore, the smaller discs 349 are interposed between the larger discs 341, in order to cover as much of the area of the support plate 310 as possible, with evacuated areas bounded by lip seals.

In the interests of clarity, only the upper portion of the module 340 (as seen in FIG. 1) shows the larger and smaller discs 341, 349 in full. It is to be understood that the arrangement of discs 341, 349 as shown in the upper portion of the module 340 is repeated over the entire surface thereof. The module 380 is similar to the module 340, but of a larger overall size.

The modules 320, 330 and 350 are similar to each other in construction, but are of different overall sizes. Taking the module 330 as an example, there are provided a plurality of discs 341, as in the module of 340. However, in the module 330, instead of the smaller discs 349 interposed between the larger discs 341, there are simply provided a plurality of recesses 333 with small through holes 334, similar to the components 343, 344 of FIG. 2—but without any surrounding lip seals.

In the small module 360, there are provided only recesses 333 with respective through holes 334.

In the small module 370, there are provided smaller discs 349 and, therebetween, recesses 333 with central through holes 334.

Thus, in the example of FIG. 1, there are four different types of configuration of module 320–380, and each module may be of any desired size, based on a grid of (in this example) 100 mm. Thus, the size and configuration of the modules may be chosen as required, to suit a workpiece being machined. Thus, for example, modules such as 320–350 may be chosen for heavier and/or larger components, whilst smaller modules such as 360 and 370 may be chosen for workpieces which are lighter and/or smaller. It is possible for workpieces to have parts of different sizes and/or robustness. Therefore, the modules such as 320–380 may be selected and laid out as required, to support parts of a workpiece that have different characteristics. Blank modules (without any through holes) may also be used, to blank off areas of the vacuum base plate that are not required to a particular machining operation.

It is possible also to provide at least one lip seal around an area that is not formed with any through hole—to provide a sucker-like effect, without vacuum transfer through the respective area of the support plate.

Figure 3:
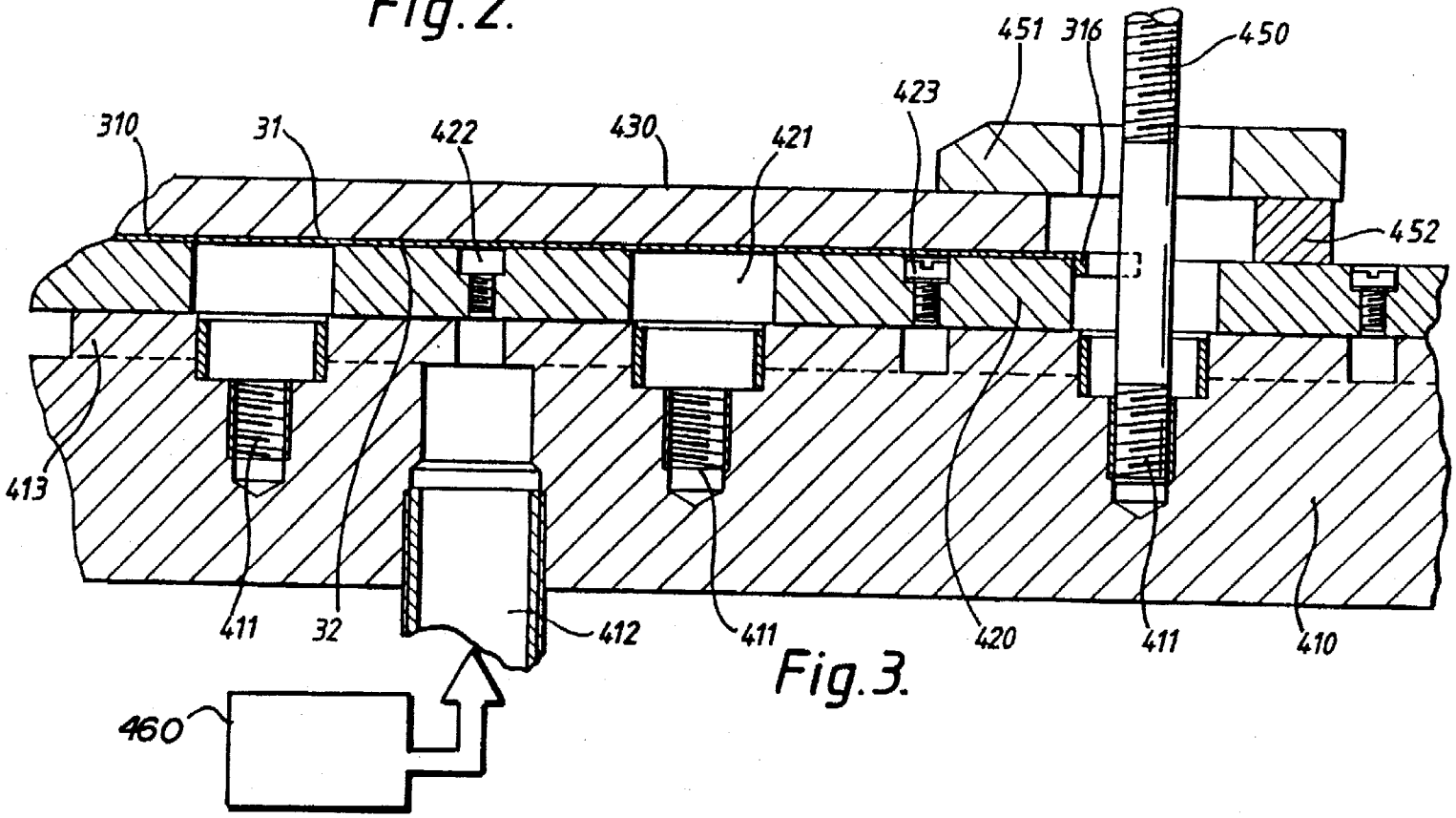
FIG. 3 is a sectional view of part of a vacuum plate system using a support plate such as is shown in FIG. 1.

Referring now to FIG. 3, there is shown a support plate 310 supported on a base plate 410, with the interposition of an intermediate member 420. A workpiece 430 is supported on the support plate 310.

Figure 4:
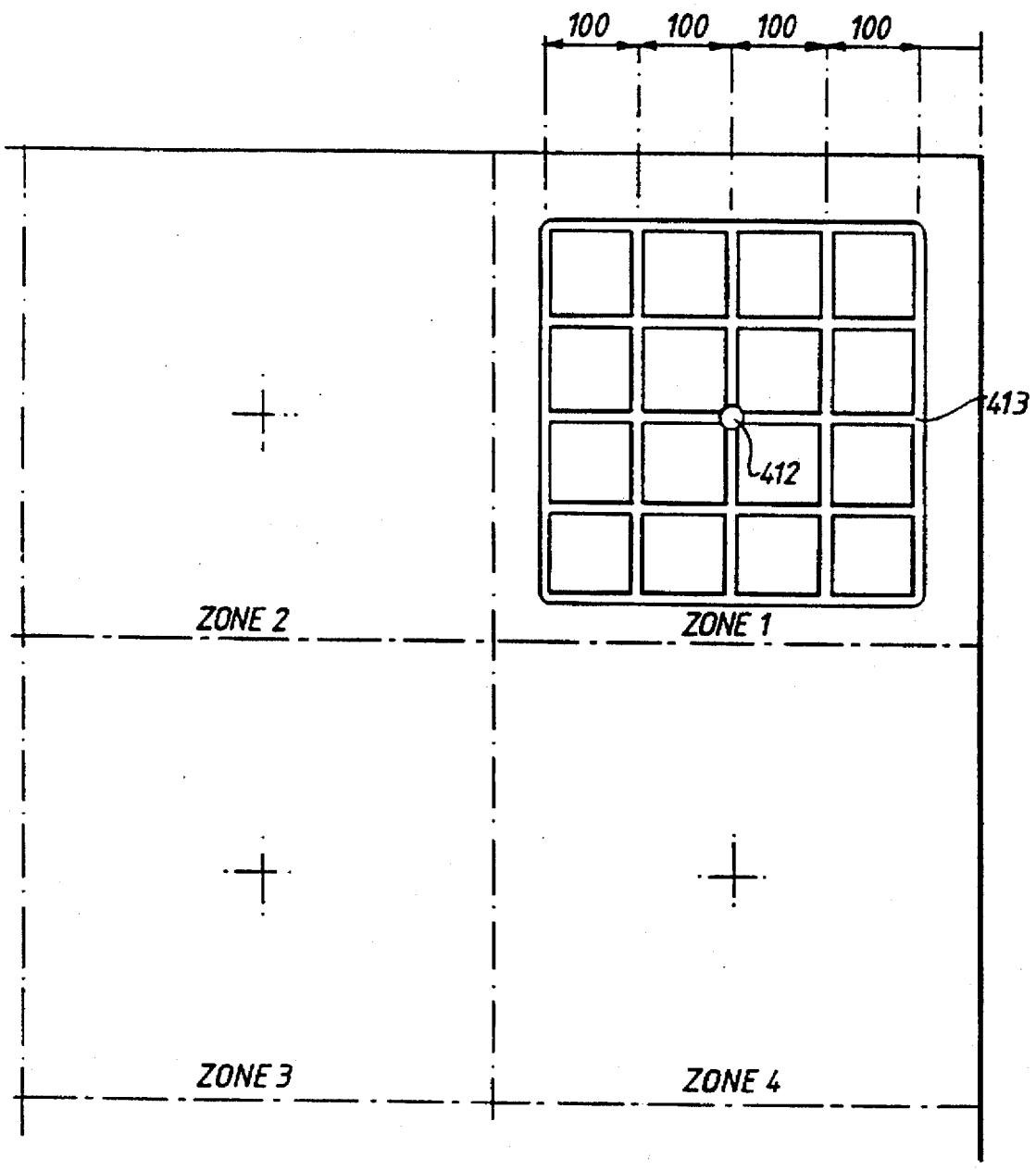
FIG. 4 is a plan view showing part of an upper surface of a vacuum base plate of the system of FIG. 3.

The base plate 410 is formed, in a known manner, with an array of locating and fixing sockets 411, which are internally screw-threaded to receive clamping bars such as 450. A vacuum supply port 412 extends through the base plate 410, and opens into a rectangular grid array of distribution grooves 413, an example of the layout of which is shown in FIG. 4.

The intermediate plate 420 is provided with a plurality of apertures 421 which register with the apertures 411 in the base plate 410. The intermediate plate 420 is also provided with a plurality of tapped apertures 422 which communicate with the distribution grooves 413, and can selectively be opened and closed by the removal and insertion of sealing bolts 423.

A clamping plate 451 is secured to the clamping bar 450, and can be tightened down upon the top of the workpiece 430. In the arrangement illustrated in FIG. 3, a spacer 452 is disposed between one side of the clamping plate 451 and the intermediate plate 420.

The modules 320–380 of the support plate 310 are formed at 100 mm intervals with part-circular recesses 315 having depending skirts 316 which engage closely with the apertures 421 provided in the intermediate plate 420, to locate the modules 320–380 precisely on the intermediate plate 420.

If desired, the intermediate plate 420 may be dispensed with. However, it may provide a simple and convenient means of providing positive and accurate location of the modules 320–380—especially where an existing vacuum table base plate 410 is to be used. The base plate 410 may be of steel or, if desired (especially if the intermediate plate 420 is not used), a composite of a steel lower portion and an aluminum top portion which provides a support surface.

Clamping bars such as 450, and other clamping means, may selectively be provided where the tapped holes 411 in the base plate 410 are exposed, if it is desired to provide additional clamping of the workpiece 430. This may be desirable with some workpieces, but may not be essential for all workpieces.

In use, vacuum is supplied to the vacuum port 412, and transmitted through the distribution grooves 413 and apertures 422 to the underside of the support plate 310. There, the vacuum is distributed on the underside of the support plate 310 to the respective module 320–380. The modules 320–380 may be provided on the their reverse surfaces with a network of distribution grooves for the vacuum. Alternatively or additionally, such a network of grooves may be provided on the upper surface of the intermediate plate 420.

As shown in FIG. 4, the network of vacuum distribution grooves 413 formed in the base plate 410 is a rectangular array having a grid dimension of 100 mm. In the example of FIG. 4, the vacuum base plate 410 is formed into a plurality of zones at 500 mm centres. Each zone has a vacuum supply port 412 at the centre thereof, and a network of distribution grooves 413 as shown in FIG. 4 for zone 1. Suitable valve means is provided for switching on and off the supply of vacuum to each of the zones, such as the four zones shown by way of example in FIG. 4.

An open vacuum aperture 422 as shown in FIG. 3 is provided at the centre of each 100 mm square as shown in FIG. 1. Thus, for example, such an open vacuum aperture 422 is provided at the centre of each of the modules 320, 360 and 370. Two such apertures 422 are provided for the module 330, and so on.

If desired, where a module such as 330, 340, 350 or 380, covers more than one such aperture 422, only one of the apertures below the respective module may be open.

Figure 5:
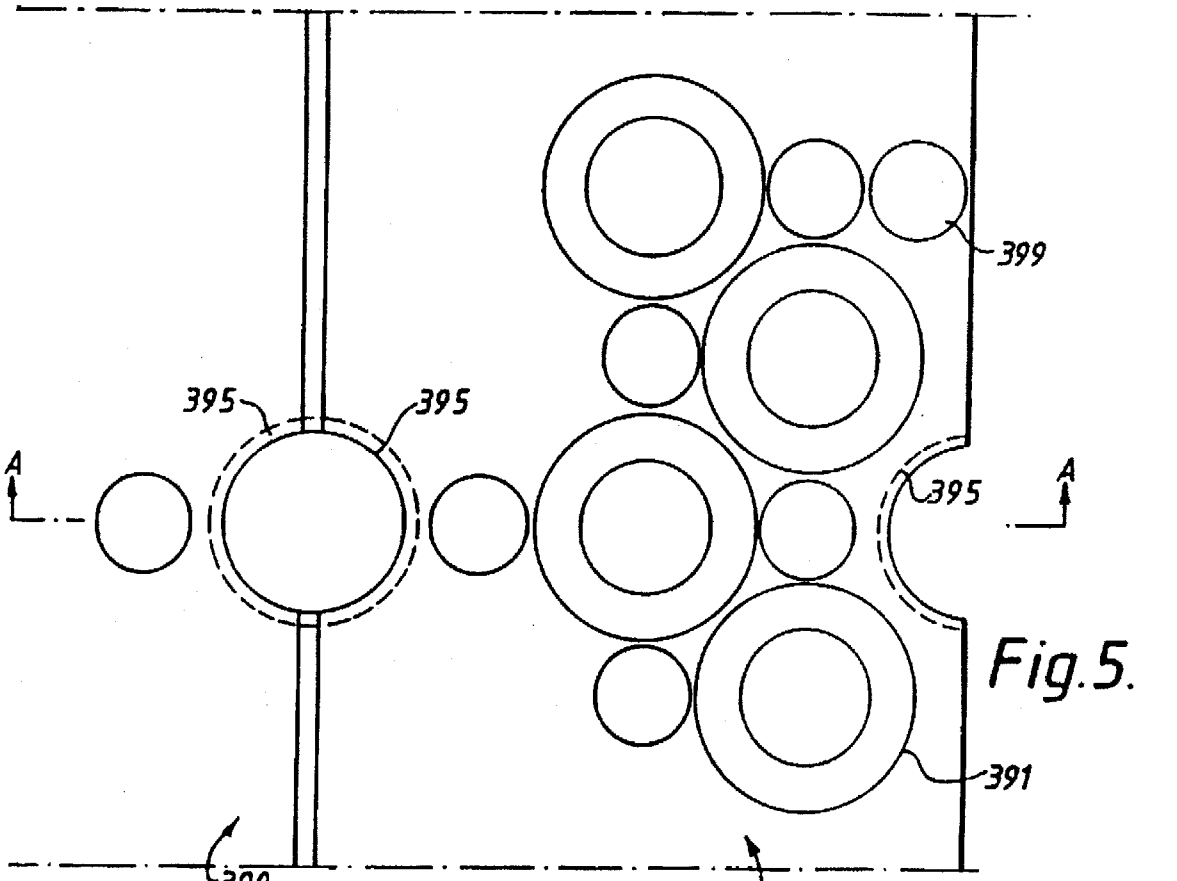
FIG. 5 is a plan view similar to that of FIG. 1, but showing part of alternative support plate modules.
Figure 6:
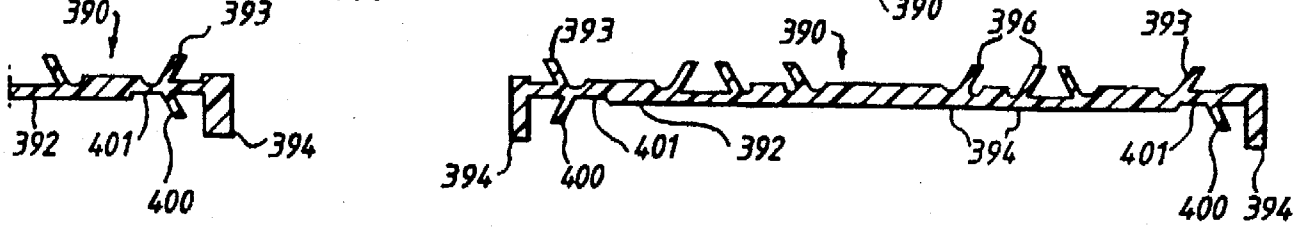
FIG. 6 is a sectional view taken on the line A—A of FIG. 5.

FIG. 5 shows a pair of adjacent modules 390, similar to the modules 340 and 380 of FIG. 1. FIG. 6 is a cross-sectional view taken on the line A—A of FIG. 5. Each module 390 is formed with a plurality of larger discs 391 and, disposed therebetween, a plurality of smaller discs 399.

The larger discs 391 are generally similar to the larger discs 341 as shown in FIG. 2. However, as may be seen in FIG. 6, each of the larger discs 391 has a pair of concentric circular ribs 396 extending upwardly and outwardly from respective recesses 397. Each of the smaller discs 399 has a single circular rib 393.

FIG. 6 shows the depending skirt 394 at each part-circular recess 395 formed in the sides and at corners of the modules 390, to provide positive location of the modules 390 on the respective intermediate plate (not shown). Depending from the reverse surface 392 of each module 390 is a resilient lip 400 which extends adjacent the periphery of the respective module 390, and extends downwardly and outwardly from a respective recess 401, so as to bear resiliently in a sealing manner against the intermediate plate below. The ribs 400 thereby provide lip seals which provide sealing for each module 390, with respect to the vacuum supply provided in the respective intermediate plate. The ribs 400 may be provided with relatively large radius corner portions, to lessen the effect of differential bending characteristics of the kind described above with reference to lip seal ribs that are non-circular in plan.

Although the various lip seals described above are flexible (e.g. elastomeric) in order to provide a sealing function, the support plates as a whole may have sufficient rigidity that they are not deformed locally where vacuum is applied to their reverse surfaces. They may be rigid, semi-rigid or flexible. Preferably, the upper working surface (such as 311) of each disc (such as 341, for example) is at the same level as the rest of the working surface of the respective module (such as 340, for example). The dimensions of the ribs (such as 346, for example) and the recesses (such as 347, for example) are preferably such that the ribs (such as 346) may be deformed downwardly such that they do not project above the adjacent working surface (such as 311).

In plan view, the resilient ribs that form the lip seals may have alternative geometric shapes, other than rectangular or circular—for example, to maximise the surface area that is evacuated and bounded by lip seals. They may be, for example, triangular, hexagonal, or elliptical in plan view. Preferably, any corners are formed with a significant radius, or other means (e.g. one or more split, fold, pleat, etc.) to minimise variations in the bending properties of the ribs.

Thus, in use of the embodiments illustrated with reference to FIGS. 1 to 6, support plates may be provided which provide good vacuum transfer characterises to workpieces, even of non-planar supported surfaces. Good vacuum transfer may be maintained, even where some of the discs (e.g. 341, 349, etc.) are cut through. The interposition of smaller discs (such as 349, for example) between larger discs (such as 341, for example) gives the possibility that the smaller discs may remain intact, even where adjacent larger discs are cut through, in a machining operation.

The support plate module that is shown in FIGS. 7 to 10 comprises a flexible mat 500 of plastics material. Preferably, the plastics material has a high coefficient of friction. As an example, the material EVA (Ethyl Vinyl Acetate) may be used, having a coefficient of friction μ of approximately 6 (or other values—e.g. less than 6).

The mat 500 has an upper, working surface 501 and a lower, reverse surface 502. Each of the surfaces 501 and 502 is formed with a respective array of channels or grooves 503, 504, which define therebetween substantially plane lands 505, 506. An upper lip 510 is formed around the periphery of the upper surface 501, and a lower lip 511 is formed around the periphery of the lower surface 502. The lips 510, 511 serve as lip seals, generally as described above with reference to the preceding embodiments.

The mat 500 is not formed with a relatively large number of small diameter bleed holes, as in most of the preceding embodiments. Instead, the mat 500 is formed with six (for example) relatively large diameter through holes 515, which are of a diameter comparable to that of vacuum transfer holes 521 formed in a vacuum base plate 520 on which, in use, the mat 500 is placed (see, for example, FIG. 10).

Depending from the lower surface 342 of the mat 500, around each of the through holes 515, is a respective set of four projections 518, which may serve as spigots to locate in vacuum holes formed in the respective vacuum base plate 520, or other recesses, to provide location of the mat 500 with respect to the vacuum base plate 520.

Figure 10:
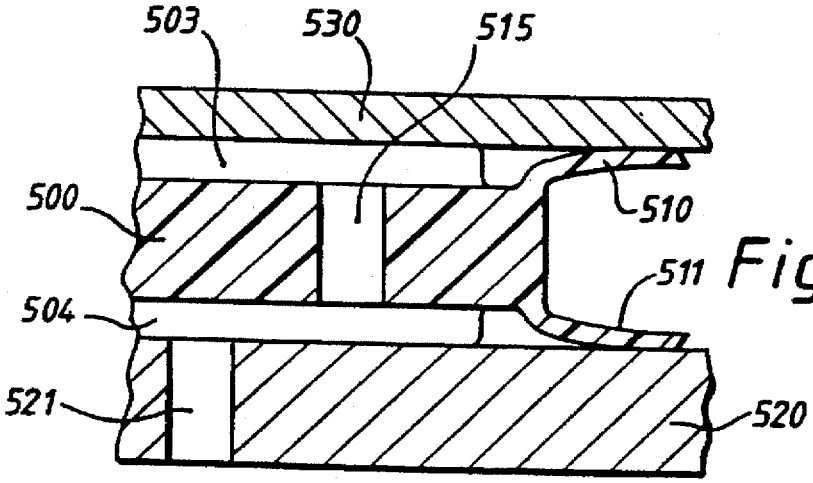
FIG. 10 is a view similar to FIG. 9, but showing the module in use between a vacuum base plate and a workpiece.

It is to be noted that, in FIG. 10, the through hole 515 is not shown in register with the adjacent vacuum hole 521, and they are shown to be of substantially the same diameter. This is to illustrate that it is not essential for these holes to be in register. However, in a preferred arrangement, they are indeed in register, and the vacuum hole 521 may be of sufficiently large diameter, at least at its upper portion, to receive the depending spigots 518, to locate the mat 500.

It is to be noted further that the depending spigots 518 may optionally interact with valve members located in the vacuum base plate 520, to selectively open and close vacuum holes such as 521. Such operation is disclosed in our above-mentioned PCT specification WO 92/10336. Conveniently, the respective valve means may be located within or adjacent to the vacuum holes such as 521.

In use, the mat 500 is applied to the vacuum base plate 520, and a workpiece 530 rests on the mat 500. Preferably, the spigots 518 locate in the vacuum holes 521.

Upon applying vacuum to the vacuum holes 521, the vacuum prevails throughout the network of grooves 503 and 504, so that the mat 500 is sucked closely to the vacuum base plate 520 and, in turn, the workpiece 530 is sucked firmly onto the mat 500.

In this embodiment, the mat 500 is not intended to be cut through, in a machining operation on the workpiece 530. The provision of the lips 510 and 511 around the periphery of the mat 500, at both upper and lower surfaces, enables a good vacuum to be maintained between the vacuum base plate 520 and the workpiece 530. It is, however, to be appreciated that the mat 500 may be modified so as to incorporate a plurality of small bleed holes and/or circular lip seals, if desired—for example, along the lines of the embodiment of FIG. 1, etc.

Figure 7:
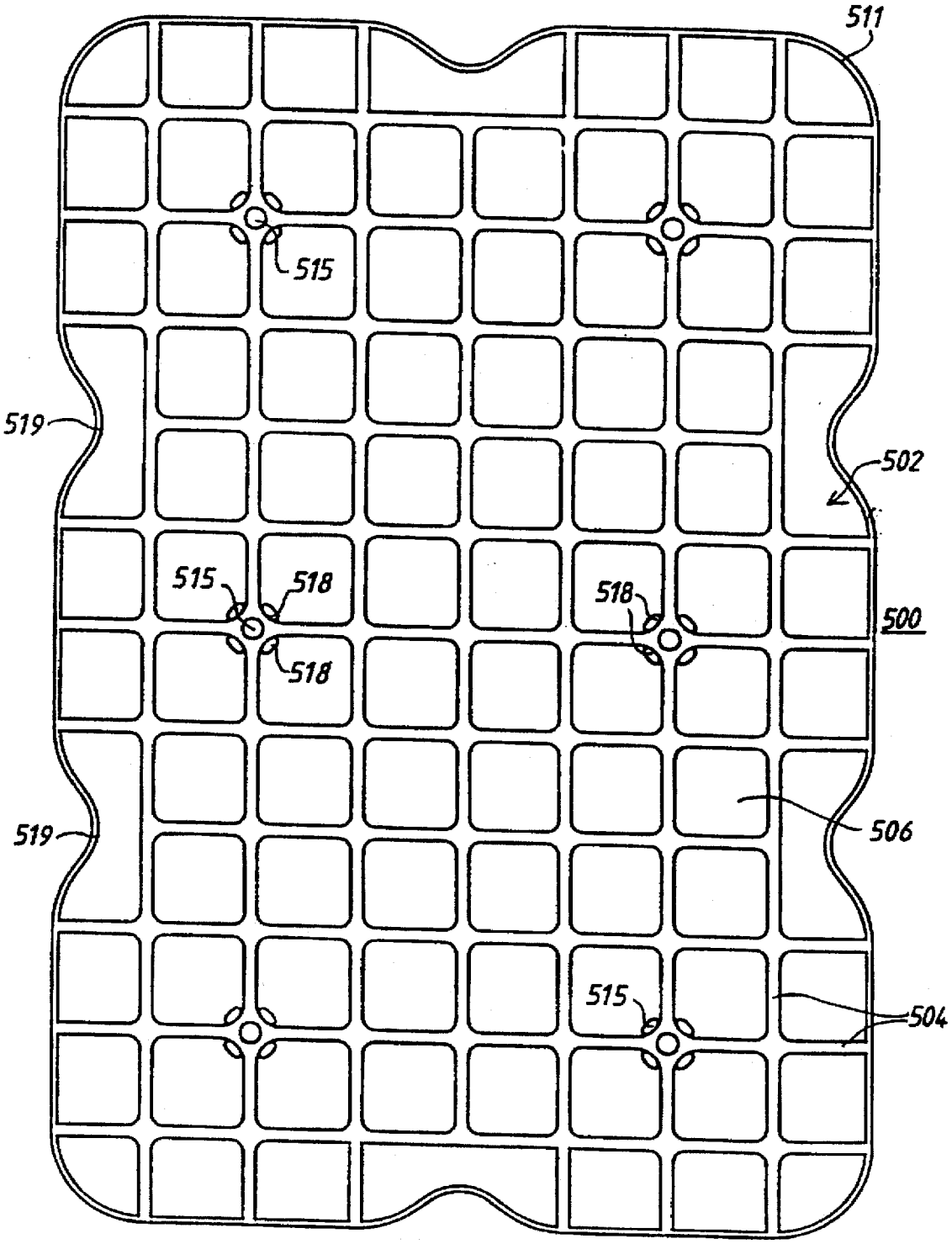
FIG. 7 shows, in bottom plan view, an alternative support plate module.

In a preferred embodiment, a mat as shown in FIG. 7 is modified so that its upper working surface has formed integrally therein, in place of the array of channels or grooves 503, lip seals formed by ribs that are circular in plan view—as in the module 340, for example, of FIG. 1. Then, through holes such as 344 and (optionally) recesses such as 343 of FIG. 2 replace the larger diameter holes 515 of FIGS. 7 to 10.

FIG. 10 shows how the lip seals 510 and 511 deform to provide effective and significant sealing surfaces against the workpiece 530 and vacuum base plate 520. The resilient nature of the lip seals 510 and 511 enable them to conform to surface imperfections of the workpiece 530 and vacuum base plate 520. Such conformity may alternatively be provided by a lip seal that is plastic but not necessarily elastic. Either one of the lip seals 510, 511 may be omitted, if desired.

Preferably, as mentioned above, the lands 505 and/or 506 may be roughened, to allow negative pressure to diffuse across the mat. This may be effected by scratching or scarifying, or as part of a moulding or other manufacturing process. Otherwise, if the lands 505 and/or 506 were perfectly smooth, sealing may tend to occur around the lands, at the edges of the grooves, whereby the lands could become isolated and prevent transfer of negative pressure across them, and thereby cause the vacuum holding effect to deteriorate.

In an advantageous variant, adhesive 540 is applied to the lands 505, and is preferably a light temporary adhesive which adheres strongly preferentially to the mat 500, but also relatively lightly to the workpiece 530.

For example, the adhesive 540 may be sprayed onto the mat 500 by means of a mask, so as to avoid the grooves 504 and the lip 510 (and any other lips that may be provided on the mat surface, as in preceding embodiments). Then, the mat 500 may be applied to the workpiece, with a high degree of accuracy, if required. Then, the workpiece with mat 500 attached may be laid on the vacuum base plate 520, the spigots 518 providing accurate positioning of the mat 500 thereon. After machining of the workpiece 530, it may be removed from the mat 500, at which point the adhesive remains firmly secured to the mat 500, but leaves the surface of the workpiece 530 entirely free of adhesive.

If desired, a mask may be chosen so as to spray adhesive 540 preferentially onto only those areas of the mat 500 where it is required. In a variant, adhesive 540 may be selectively negated in selected areas—e.g. by the application of talcum powder, where adhesion is not required.

Figure 8:
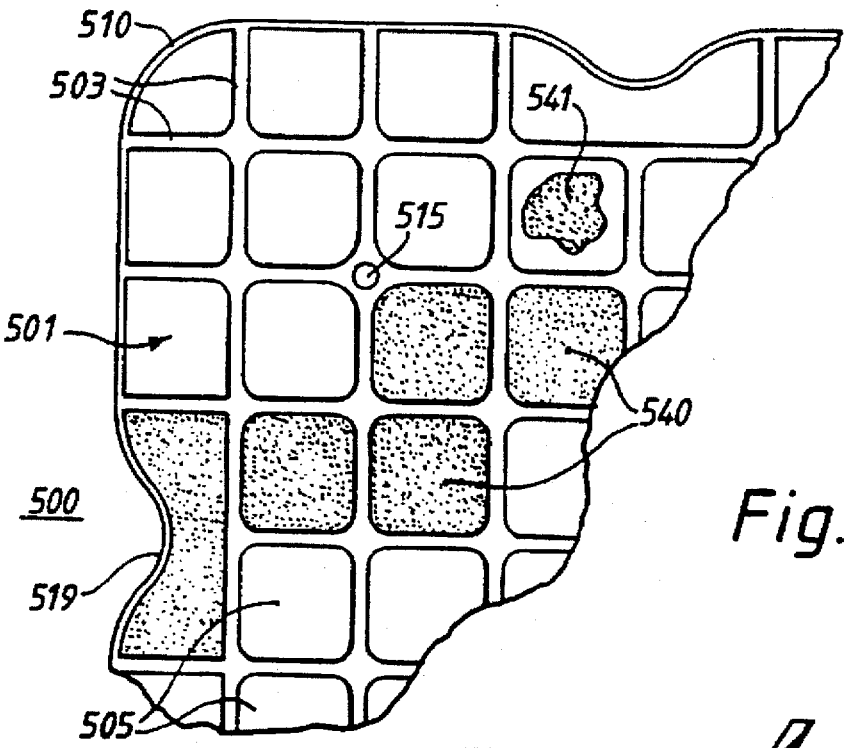
FIG. 8 is a partial top plan view of the module of FIG. 7.
Figure 9:
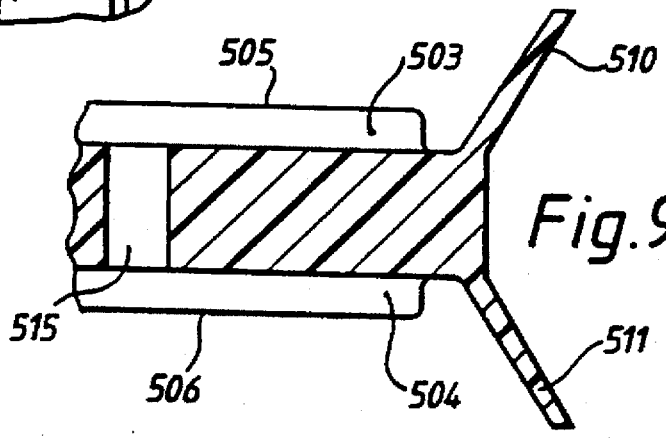
FIG. 9 is a partial sectional view of a periphery of the module of FIG. 7.

For ease of illustration, adhesive 540 is shown only on a few of the lands 505 in FIG. 8, but may be applied as extensively as required. In FIG. 8 there is also shown an alternative quantity of adhesive 541 which has not been spray applied, but comprises a metered dose of adhesive applied substantially centrally in the respective land 505, to spread out to a predetermined degree upon adhesion to the workpiece 530, without reaching the grooves 503. As seen in plan view, the mat 500 has a plurality of cut-outs 519 around its edge. These may serve purposes similar to those described above for the recesses 315 in the embodiment of FIGS. 1 to 3, etc. That is, for example, they may expose tapped holes for the securing of ancillary fittings, and/or they may provide means for supplying hydraulic or pneumatic working fluid to such fittings. They may also provide clearance for pneumatic apertures through which pressurised air (or other gas) may be supplied to support, for example, a respective workpiece on an air cushion above the vacuum plate system.

In another modification, the mat 500 may be produced as a relatively large circular disc (e.g. of a diameter in the range 20 to 500 mm). Then, a plurality of such mats may be selectively placed on a vacuum base plate, to provide suction and vacuum where required to a workpiece engaged on the circular mats. Such circular mats may incorporate any of the features or variations mentioned above.

Figure 11:
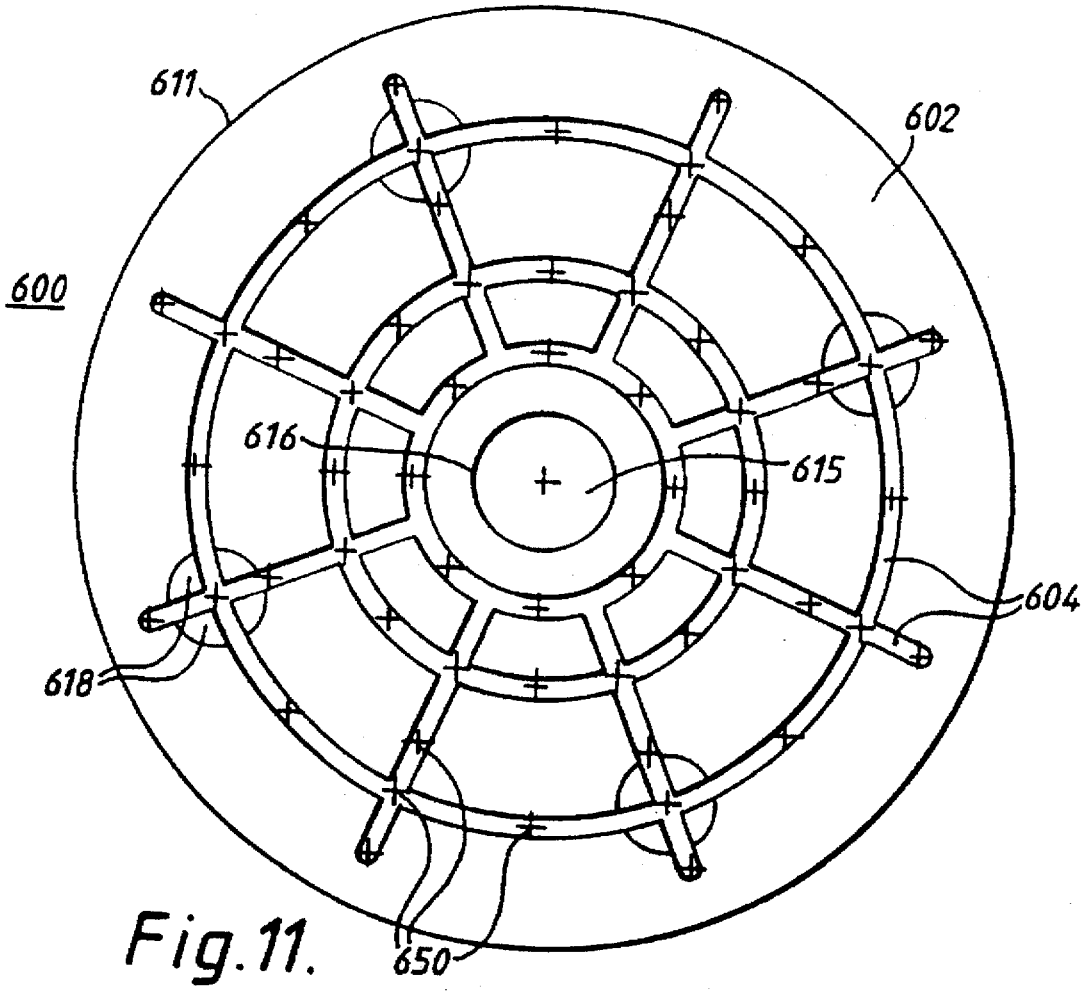
FIG. 11 is a bottom plan view of a circular mat.

FIG. 11 shows an example of such a circular mat 600. An array of grooves 604 is formed on the reverse surface 602 of the mat 600, and as the mat is circular in plan view, the array comprises concentric circular grooves interconnected by radial grooves. Locating spigots 618 serve to locate the mat 600 on a respective base plate, in a manner similar to the projections 518 of the rectangular mat 500. The mat 600 is formed with a plurality of small through holes 650 to transfer vacuum or other pressure between the reverse surface 602 and the upper, working surface of the mat 600. Alternatively, larger holes similar to the holes 515 of the mat 500 may be provided. The upper, working surface of the mat 600 may be formed with an array of grooves similar to the array of grooves 604. The mat 600 may be provided around the periphery of its reverse surface 602 with a lip 611 to form a peripheral lip seal, like the lip seal 511 of the mat 500. Similarly, a peripheral lip seal may be provided on the upper, working surface of the mat 600, like the lip seal 510 of the mat 500.

The mat 600 may be provided with a central hole 615, around which there may be provided on the reverse surface 602 a lip seal 616 similar to the lip seal 611, and optionally also a similar lip seal on the upper, working surface. The central hole 615 may serve to assist location of the mat 600 and/or location and/or fixing of accessories or ancillary fittings to a base plate on which the mat 600 is disposed. In this regard, the central hole 615 may serve a similar function to cut-outs such as the cut-outs 519 of FIGS. 7 and 8.

Figure 12:
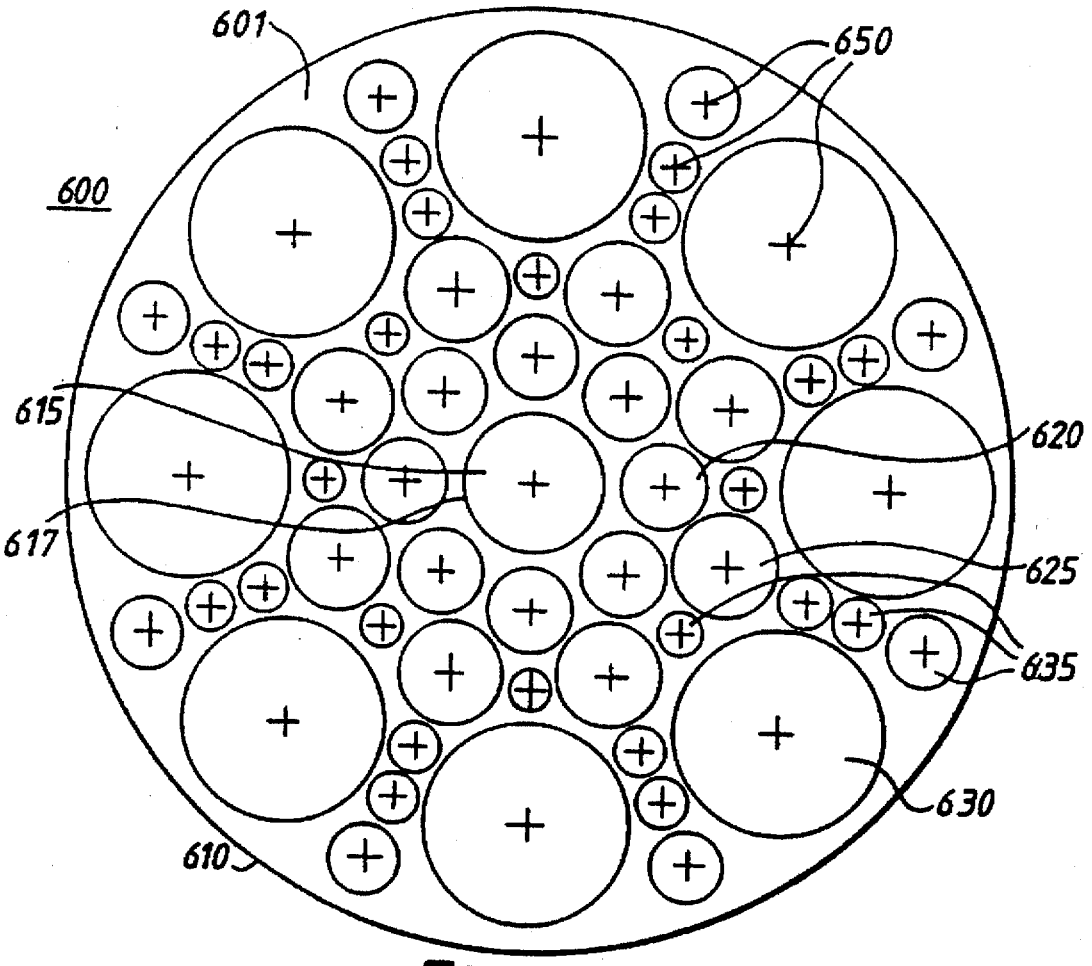
FIG. 12 is an example of a top plan view of the circular mat.

In the embodiment shown in FIG. 12, the mat 600 is formed on its upper, working surface 601 with a plurality of lip seals 620, 625, 630, 635 that are circular in plan view. Preferably, the lip seals 620, 625, 630, 635 are formed integrally with the mat 600, and function in a manner similar to the lip seals of FIG. 1. Thus, each of the circular lip seals 620, 625, 630, 635 is provided with a respective one of the small through holes 650 within the area bounded by the lip seal. As in preceding embodiments, some of the circular lip seals 620, 625, 630, 635 may, alternatively, not be provided with a respective one of the small through holes 650 within the area bounded by the lip seal.

As may be seen in FIG. 12, the diameter of the circular lip seals 620 nearest the centre of the mat 600 is relatively small. The diameter of the lip seals 625 further away from the centre is greater, and that of the lip seals 630 yet further away is greater still. Smaller lip seals 635 are preferably interposed between larger lip seals 630, 625, 620 as desired.

Peripheral lip seals 610 and 617 may be provided on the working surface 601 at or adjacent the outer and inner periphery of the mat 600, and preferably also similar seals on the reverse surface.

In a variant of the preceding embodiments, the central hole 615 is replaced by a central circular lip seal which is similar to the lip seals 625 on the upper, working surface 601, and is provided with a small central through hole 650.

Figure 14:
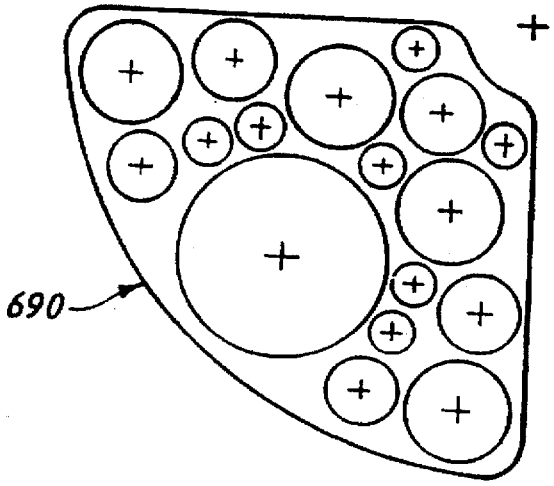
FIG. 14 is a top plan view of a quarter-circular mat.
Figure 13:
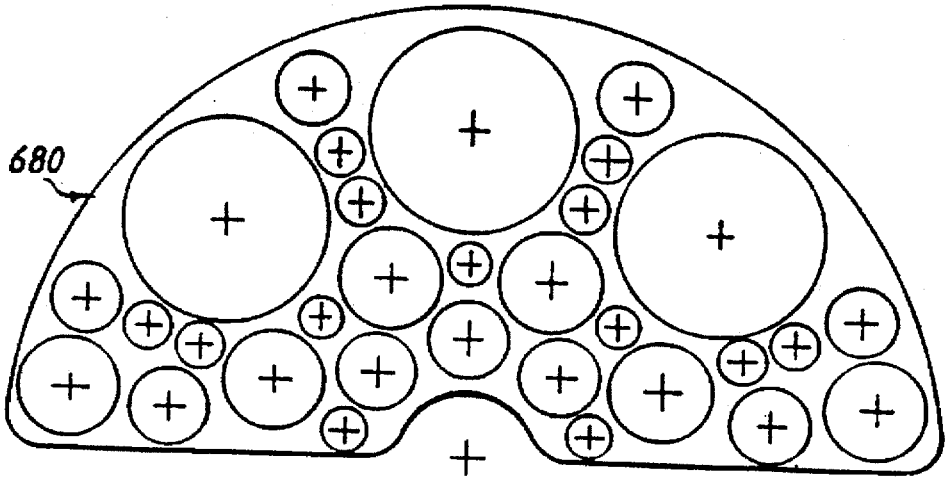
FIG. 13 is a top plan view of a semi-circular mat.

FIGS. 13 and 14 show mats 680 and 690 similar to the mat 600, but respectively of semi-circular and quarter-circular shape, in plan view.

Figure 15:
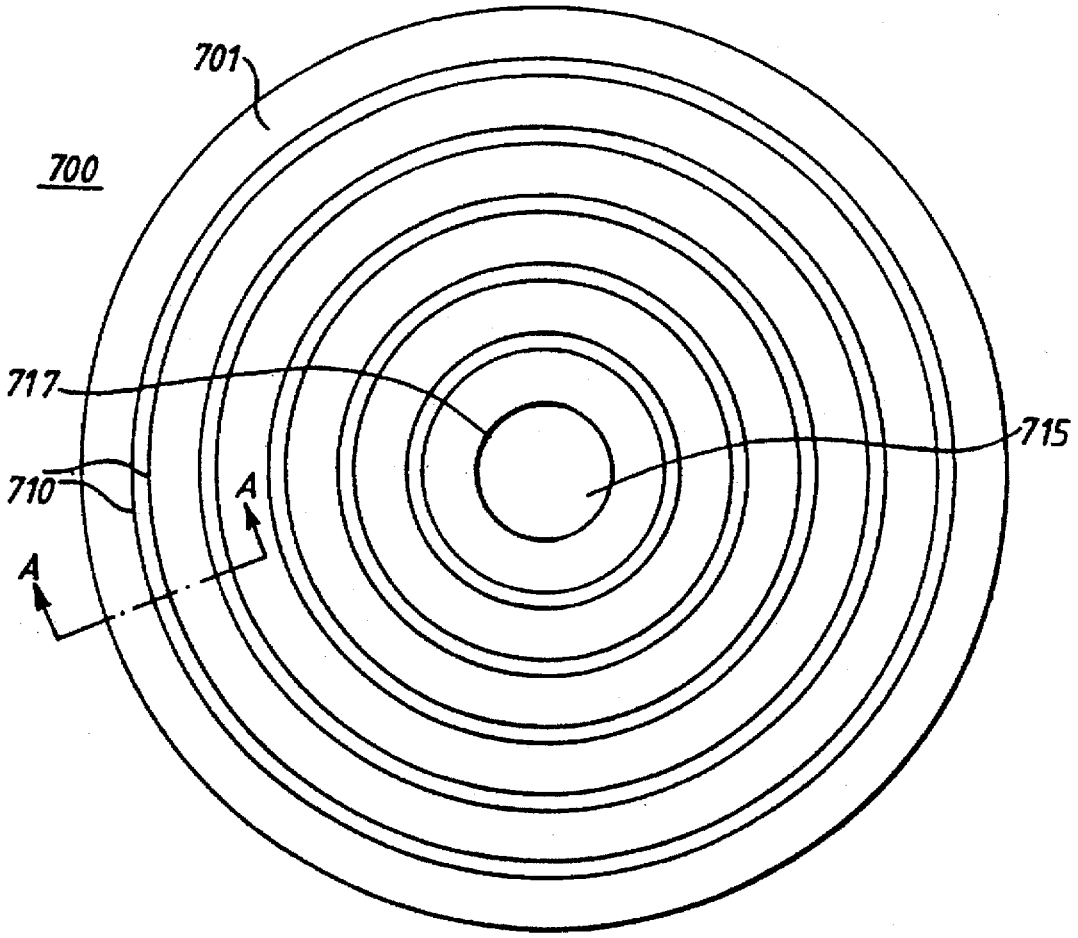
FIG. 15 is a top plan view of a variant of a circular mat.

In the modification of FIG. 15, lip seals 710 that are circular and arranged concentrically in plan view are formed on an upper working surface 701 of a circular mat 700. As shown in the detail view of FIG. 16, each lip seal 710 is formed of a respective resilient projection 708 that extends upwardly and outwardly or upwardly and inwardly from an annular groove 705 that opens into the working surface 701. Small holes 720 allow vacuum (or other pressure) to be transferred between the working surface 701 and a reverse surface 702, where a network of distribution grooves (e.g. like the grooves 604 of FIG. 11) may optionally be provided. Alternatively or additionally, larger holes 730 may be provided to transfer pressure between the working surface 701 and the reverse surface 702.

Figure 16:
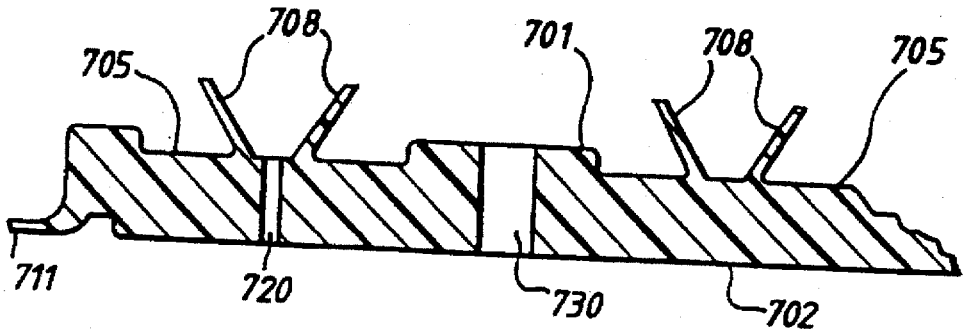
FIG. 16 is a detail view on the line A—A of FIG. 15.

In FIG. 16, the mat 700 has an outer peripheral lip seal on the reverse surface 702. A similar seal may be provided alternatively or additionally on the working surface 701. An inner lip seal 717 bounds an area 715 of the working surface 701 that is either a relatively large central hole or a solid portion with, optionally, a small central through hole. A similar seal may be provided alternatively or additionally on the reverse surface 702.

It will be appreciated that the mats 600, 700 may be used generally as described above with reference to the preceding embodiments, and/or as described in the published specification of our PCT patent application No. WO 92/10336.

Features of the mats 600 may be used in the mats 700 and vice-versa, as desired.

Where the illustrated modules and/or mats are of plastics, they may conveniently be of an alloy of different plastics materials, to give desired properties as to resilience, moulding properties, flexibility (or rigidity), etc.

In use of support plates as mentioned above, a method of working on a workpiece may comprise a preliminary step of positioning the workpiece on the support plate (or an array thereof), applying a low degree of vacuum to hold the workpiece lightly in an approximate position, tapping (or otherwise adjusting) the workpiece into a final accurate position, and then applying a higher degree of vacuum to hold the workpiece more firmly in that final position. These positioning steps may be carried out, at least partly, by an electronic scanning device that scans the workpiece and the vacuum plate system to determine the relative positions thereof, and a positioning device engages the workpiece and is optionally servo-controlled in response to the scanning device. To this end, the vacuum base plate and/or support plate(s) and/or workpiece may carry reference markings, to facilitate scanning.

Colour marking (or other pattern or reference marking) of support plate modules of any of the above described embodiments of the invention may assist identification (manual or automatic) of modules having different characteristics or purposes.

By way of example only, support plates as described above may have a thickness in the range 1 to 10 mm, and vacuum or pressure distribution grooves may a width in the range 1 to 10 mm and a depth in the range 0.1 to 5 mm.

The reader's attention is directed to all papers and documents which are filed concurrently with or previous to this specification and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

We claim:

1. A support plate positionable between a base plate of a vacuum plate system and a workpiece to be held by the vacuum plate system, the support plate comprising:

a sheet of flexible material having a reverse surface and a working surface for contact respectively with a said base plate and workpiece;

a plurality of holes that pass through the sheet of material to transfer vacuum, in use, between said reverse and working surfaces; and a plurality of resilient projections formed integrally in said sheet, each provided on said working surface round a respective one of said holes to form, in use, a seal with a contact surface of a respective workpiece, the seal formed by each of said resilient projections having a closed, circular shape and the seals being provided in smaller and larger sizes with seals of a smaller size being interposed between seals of a larger size.

2. A support plate according to claim 1, comprising at least one further said seal of a closed, circular shape which does not have a respective said hole within it.

3. A support plate according to claim 1, wherein at least one network of open grooves is formed in said reverse surface to open into the reverse surface.

4. A support plate according to claim 3, wherein said holes open into said network of grooves.

5. A support plate according to claim 3, wherein at least one said network comprises a rectangular array of grooves.

6. A support plate according to claim 1, further comprising a peripheral resilient projection that is formed integrally with said sheet at or adjacent the periphery of the sheet to form, in use, a peripheral seal that extends around said periphery and engages a contact surface of either a respective said base plate or a respective said workpiece.

7. A support plate according to claim 6, wherein said peripheral resilient projection extends from said working surface.

8. A support plate according to claim 6, wherein said peripheral resilient projection extends from said reverse surface.

9. A support plate according to claim 6, wherein a respective said peripheral resilient projection extends from each of said reverse and working surfaces to form, in use, a respective seal that extends around said periphery and engages respectively a contact surface of a respective said base plate and a respective said workpiece.

10. A support plate according to claim 6, wherein said peripheral seal or at least one of said peripheral seal extends around a major portion of said periphery.

11. A support plate according to claim 6, wherein said peripheral seal or at least one of said peripheral seals extends continuously around said periphery.

12. A support plate according to claim 1, wherein said material is a plastics material.

13. A support plate according to claim 1, wherein at least one of said surfaces of the support plate is formed with surface roughness to assist the transfer of positive or negative pressure across that surface.

14. A support plate according to claim 13, wherein said surface roughness is formed by abrasion of said surface.

15. A support plate according to claim 13, wherein said surface roughness is formed by a moulding process during manufacture of said support plate.

16. A support plate according to claim 13, wherein said surface roughness is formed by a pressing process during manufacture of said support plate.

17. A support plate according to claim 1, comprising locating means which are provided on said reverse surface and cooperate with means on a respective said base plate to locate the support plate in position on the base plate.

18. A support plate according to claim 1, being of a substantially at least part-circular overall shape.

19. A support plate according to claim 18, comprising a plurality of lip seals that are formed on at least one of said working and reverse surfaces of the support plate and are at least part-circular, being concentric with the at least part-circular overall shape of the support plate.

20. A support plate according to claim 18, being provided with a hole at the centre of the circle of said at least part-circular overall shape.

21. A plurality of support plates according to claim 1, of modular shape and size to make up a support plate area that is a multiple in size of a smallest module dimension.

22. A vacuum plate system comprising a support plate according to claim 1, and a respective said base plate having a vacuum connection port, at least one aperture opening into a support surface of the plate, and connection means connecting said aperture with said port.

23. A vacuum plate system according to claim 22, further comprising control means for controlling the supply of pressure to said at least one aperture.

24. A vacuum plate system according to claim 22, wherein the support plate is shaped to expose in the base plate at least one clamping means to which a workpiece holding means may be secured.

* * * * *